US005138919A

United States Patent [19]

Wilhelm

[11] Patent Number: 5,138,919

[45] Date of Patent: Aug. 18, 1992

[54] MAGNETIC HOLDER FOR PUNCH STRIPPER

[76] Inventor: Arthur L. Wilhelm, 748 Hampton Rd., Grosse Pointe Woods, Mich. 48236

[21] Appl. No.: 627,183

[22] Filed: Dec. 13, 1990

[51] Int. Cl.[5] ..... B21D 45/00; B26F 1/14

[52] U.S. Cl. ..... 83/139; 83/698

[58] Field of Search ..... 83/139, 138, 140, 141, 83/142, 143, 146, 698, 136, 146

[56] References Cited

U.S. PATENT DOCUMENTS

| | | | |
|---|---|---|---|
| 3,211,035 | 10/1965 | Whistler, Sr. et al. | 83/139 |
| 3,234,835 | 2/1966 | Archbold et al. | 83/139 |
| 3,269,238 | 8/1966 | Whistler, Sr. et al. | 83/139 |
| 3,485,122 | 12/1969 | Achler et al. | 83/139 |
| 3,517,579 | 6/1970 | Reichert | 83/533 |
| 3,690,205 | 9/1972 | Brown | 83/139 |
| 3,871,254 | 3/1975 | Whistler, Jr. et al. | 83/139 |
| 4,103,413 | 8/1978 | Malmberg | 83/139 X |
| 4,104,941 | 8/1978 | Krueger | 83/133 |
| 4,166,403 | 9/1979 | DiDonato, Jr. et al. | 83/139 X |
| 4,428,262 | 1/1984 | Vlahek | 83/139 |

*Primary Examiner*—Hien H. Phan
*Assistant Examiner*—Eugenia A. Jones
*Attorney, Agent, or Firm*—Barnes, Kisselle, Raisch, Choate, Whittemore & Hulbert

[57] ABSTRACT

A stripper for stripping a punched workpiece from a punch of a punch press when the punch is withdrawn from the workpiece. The stripper is an elongated tubular member of elastomeric material. The stripper has a magnetic holder on one end to retain the stripper on the punch by magnetic attraction.

9 Claims, 1 Drawing Sheet

MAGNETIC HOLDER FOR PUNCH STRIPPER

This invention relates generally to punch strippers and refers more particularly to a magnetic holder for a punch stripper.

BACKGROUND AND SUMMARY OF THE INVENTION

Punch strippers now in use are usually in the form of tubular members which are made of elastomeric material and sleeved on punches used to pierce holes in metal parts during stamping operations. The stripper strips the part from the punch when the punch is withdrawn. The stripper is held on the punch by friction alone.

One problem in the use of such strippers is that, through continued use, the frictional bond between the stripper and the piercing punch becomes weakened or loosened. When this happens the stripper can fall off the punch causing possible damage to the stamping equipment and almost certainly causing the loss of a number of pierced parts until the problem is detected and corrected.

In accordance with the present invention, the stripper is held on the punch by a magnetic holder. The magnetic holder may be in the form of a simple magnetic disc secured to the top of the stripper. The disc may have a flange or tabs embedded in the material of the stripper. The magnetic holder may also be in the form of a flux of solid grandular particles embedded in the end of the stripper.

One object of this invention is to provide a stripper with a magnetic holder which is of a simple, relatively inexpensive construction, is highly effective in retaining the stripper on the punch, and constitutes an improvement over strippers now in use including those shown in the following U.S. patents:

U.S. Pat. No. 115,157 Brown, et al
U.S. Pat. No. 2,805,717 Taylor
U.S. Pat. No. 3,234,835 Archbold, et al
U.S. Pat. No. 3,269,238 Whistler, et al
U.S. Pat. No. 3,485,122 Achler, et al
U.S. Pat. No. 3,690,205 Brown
U.S. Pat. No. 3,827,322 Saunders, et al
U.S. Pat. No. 3,871,254 Whistler, et al
U.S. Pat. No. 4,166,403 DiDonato, et al
U.S. Pat. No. 4,825,739 Pfaff Other objects, features and advantages of the invention will become more apparent as the following description proceeds, especially when considered with the accompanying drawings.

DETAILED DESCRIPTION

Figure 1:
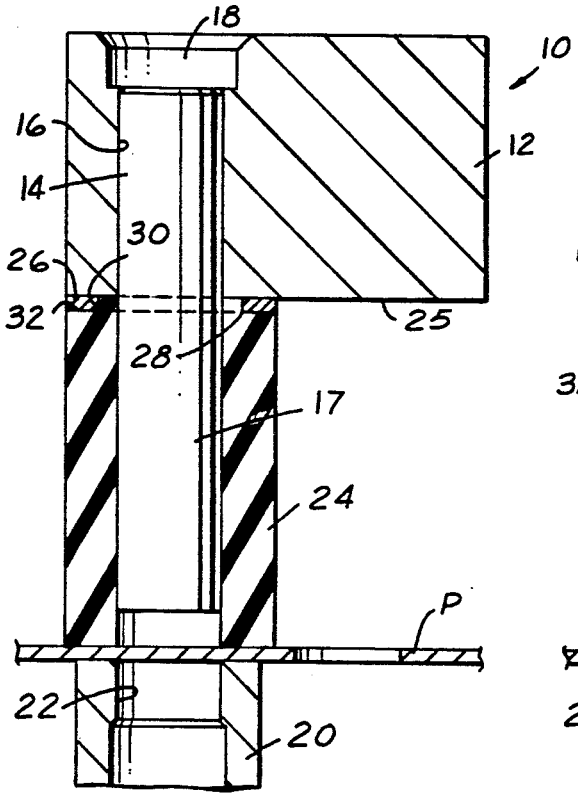
FIG. 1 is a vertical sectional view showing a punch having a stripper sleeved thereon and retained in place by a magnetic holder, the punch being shown in position to pierce a workpiece.
Figure 2:
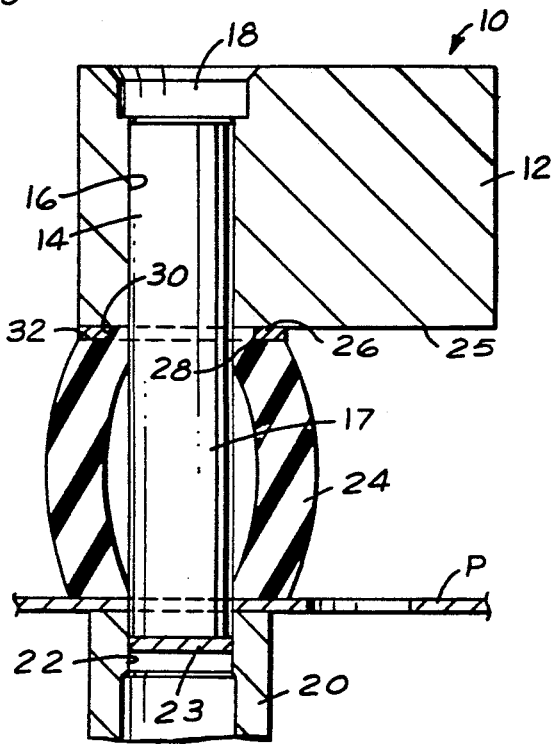
FIG. 2 is a view similar to FIG. 1 but shows the parts after the punch has pierced a hole in the workpiece.

Referring now more particularly to the drawings and especially to FIGS. 1 and 2 thereof, the illustrated punching apparatus 10 comprises a punch retainer 12 and a punch 14.

The retainer 12 is made of a ferrous material such as iron or steel, or any other suitable material to which a magnet is attracted. The punch 14 is an elongated cylindrical member of uniform circular cross-section throughout its length which is rigidly secured by any suitable means in a cylindrical hole 16 in the retainer 12 with a portion 17 of the punch projecting downwardly beyond the retainer. A backing plate 18 rigidly mounted on the retainer 12 covers the upper end of the hole 16. The retainer 12 is supported for movement by power means (not shown) in a direction parallel to the axis of the punch which, in the illustration, is vertical.

The punch is designed to punch a hole in a workpiece which in this instance is a sheet metal plate P supported on a die 20 having an opening 22 aligned with and of substantially the same diameter as the punch. A slug 23 punched from the plate P drops through the die opening 22.

A stripper 24 is supported on the projecting portion 17 of the punch. The stripper is an elongated tubular member preferably made of a flexible, stretchable, compressible elastomeric material such as rubber. The ends of the tubular stripper are preferably cut perpendicular to the longitudinal center line thereof. The stripper has in its natural or freestate condition an inside diameter which is the same as or slightly less than the diameter of the punch and is sleeved on the punch preferably with a slight friction grip. Normally the upper end of the stripper 24 contacts the bottom surface 25 of the retainer 12, and the lower end of the stripper projects downward a short distance beyond the lower end of the punch, as shown in FIG. 1.

At the top of the stripper 24 there is a magnet in the form of an annular ring or disc 26 which has a central opening adapted to clear the punch and which is flat throughout the full 360° of its extent. The upper end of the stripper is formed with a concentric annular recess 28. Preferably, the recess 28 has a radially outwardly facing circular wall 30 which is vertical and is spaced radially outwardly from the radially inner surface of the stripper. A horizontal upwardly facing wall 32 extends from the vertical wall 30 to the radially outer surface of the stripper. The vertical dimension of the recess 28 preferably is equal to the thickness of the disc 26 and its horizontal dimension is equal to the difference between the inner radius and outer radius of the disc. The disc is secured in the recess in concentric relation to the stripper by any suitable means, such, for example, as an adhesive, with its upper surface flush with the upper end of the stripper and its radially outer edge flush with the radially outer surface of the stripper.

With the stripper 24 sleeved on the projecting portion 17 of the punch, and with its upper end in contact with the downwardly facing surface 25 of the punch retainer, it will be noted that the upper surface of the magnetic disc 26 is also in contact with the downwardly facing surface 25 of the punch retainer. Hence, the disc 26 serves as a means for magnetically retaining the stripper on the punch, strongly resisting any tendency of the stripper to drop off of the punch.

In operation, the punch 14 is retracted upwardly, somewhat above the FIG. 1 position, and the plate P is inserted under the punch and over the die 20. The punch passes downward through the plate P and into the opening in the die, but the stripper is compressed between the plate P and the retainer 12, and bulges outwardly. When the punch is again retracted to a position above that shown in FIG. 1, the stripper returns to the FIG. 1 shape. The stripper will not fall off the punch because of the holding power of the magnetic disc 26 on retainer 12. Also, the outward bulging of the stripper in the FIG. 2 position, presses the disc 26, which is on the outer edge portion of the stripper, even more firmly against the surface 25 of retainer 12 each time the punch is operated.

Figure 3:
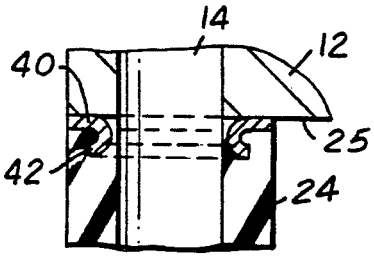
FIG. 3 is a fragmentary sectional view showing a modification of the invention.

FIGS. 3 shows a modification in which the magnetic disc 40 is exactly like the disc 26 except that its radially inner edge portion is extended and turned axially inwardly and then radially outwardly to provide an annular flange 42 embedded in the material of the stripper 24 to anchor the disc.

Figure 4:
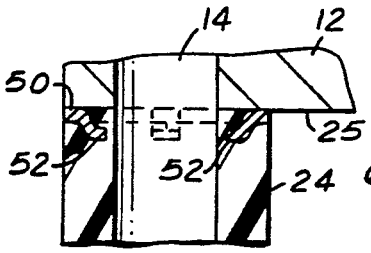
FIG. 4 is a fragmentary sectional view showing another modification.

FIG. 4 shows a modification in which the magnetic disc 50 is exactly like disc 26 except that it is cut along lines extending radially outwardly from its radially inner edge to provide angularly spaced tabs 52 which are turned axially inwardly and embedded in the material of the stripper 24 to anchor the disc.

In both FIGS. 3 and 4, the top surface of the disc is exposed and flush with the upper end of the stripper, and the radially outer surface of the disc is exposed and flush with the radially outer surface of the stripper.

Figure 5:
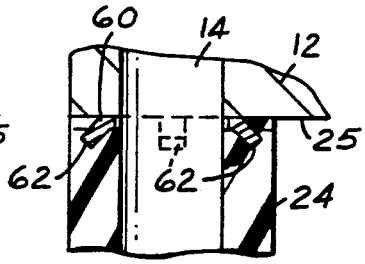
FIG. 5 is a fragmentary sectional view showing a further modification.

FIG. 5 shows a modification in which the magnetic disc 60 is like the disc 50 except that the angularly spaced tabs 62 which are turned axially inwardly and embedded in the material of the stripper 24 are formed by cutting the disc along line extending radially inwardly from the radially outer edge portion of the disc. The top surface of the disc is exposed and flush with the upper end of the stripper, and the radially outer surface of the disc between the tabs is exposed and flush with the radially outer surface of the stripper.

Figure 6:
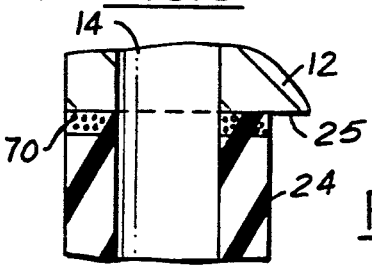
FIG. 6 is a fragmentary sectional view showing still another modification.

FIG. 6 shows a modification in which, instead of a disc, the magnetic holder consists of particulate material 70 embedded in the upper end portion of the stripper. Some of these magnetic particles either project through, or are close enough to the surface to magnetically attract retainer 12 through the upper end and radially outer surface of the stripper.

What is claimed is:

1. In apparatus for punching a hole in a workpiece, a punch retainer formed of a material capable of being attracted by a magnet an elongated punch carried by and protecting from said retainer, said retainer having a surface projecting radially outwardly from said punch, said punch having a workpiece-engaging end spaced from said surface of said retainer, a stripper for stripping a punched workpiece from said punch when said punch is withdrawn from the workpiece, said stripper comprising an elongated tubular member of flexible, stretchable material sleeved on said punch, said tubular member having a first end adjacent said surface of said retainer and a second end extending beyond said workpiece-engaging end of said punch, and a magnetic holder on said first end of said tubular member engaging said surface of said retainer to magnetically connect said tubular member to said retainer sleeved on said punch, said second end of said tubular member making pressure contact with the workpiece during each punching of a hole therein and bulging radially outwardly to press said magnetic holder more firmly against said surface of said retainer.

2. Apparatus as defined in claim 1, wherein said magnetic holder is a flat annular disc concentric with said tubular member and having full surface-to-surface engagement with said surface of said retainer.

3. Apparatus as defined in claim 1, wherein said magnetic holder is an annular disc having a radially inner edge turned axially inwardly to provide an annular flange embedded in said tubular member.

4. Apparatus as defined in claim 1, wherein said magnetic holder is an annular disc having a radially inner edge turned axially inwardly and then radially outwardly to provide an annular flange embedded in said tubular member.

5. Apparatus as defined in claim 1, wherein said magnetic holder is an annular disc having a radially inner edge provided with angularly spaced tabs turned axially inwardly and embedded in said tubular member.

6. Apparatus as defined in claim 1, wherein said magnetic holder is an annular disc having a radially outer edge provided with angularly spaced tabs turned axially inwardly and embedded in said tubular member.

7. Apparatus as defined in claim 1, wherein said magnetic holder is in the form of magnetic granules molded in said first end of said tubular member.

8. In apparatus for punching a hole in a workpiece, a punch retainer formed of a material capable of being attracted by a magnet, an elongated punch carried by and projecting from said retainer, said retainer having a surface projecting radially outwardly from said punch, said punch having a workpiece-engaging end spaced from said surface of said retainer, a stripper for stripping a punched workpiece from said punch when said punch is withdrawn from the workpiece, said stripper comprising an elongated tubular member of flexible, strechable material sleeved on said punch, said tubular member having a first end adjacent said surface of said retainer and a second end extending beyond said workpiece-engaging end of said punch, and magnetic means on said first end of said tubular member engaging said surface of said retainer to magnetically hold said tubular member on said punch, said tubular member having a radially inner cylindrical surface, said tubular member having an annular recess in said first end concentric with said tubular member and spaced radially outwardly from said inner cylindrical surface, and said magnetic means comprising an annular disc disposed in said recess and engageable with said surface of said retainer, said disc being separated from said punch by the portion of said first end of said tubular member between said recess and said inner cylindrical surface.

9. Apparatus as defined in claim 8, wherein said disc has an outer surface engageable with said surface of said retainer as aforesaid, said outer surface of said disc being flush with said first end of said tubular member.

* * * * *

UNITED STATES PATENT AND TRADEMARK OFFICE

CERTIFICATE OF CORRECTION

PATENT NO. : 5,138,919

DATED : August 18, 1992

INVENTOR(S) : Arthur L. Wilhelm

It is certified that error appears in the above-indentified patent and that said Letters Patent is hereby corrected as shown below:

Column 3, line 50 after "magnet" there should be a --,--

Column 3, line 51 "protecting" should be --projecting--

Signed and Sealed this

Twenty-fourth Day of August, 1993

*Attest:*

*Attesting Officer*

BRUCE LEHMAN

*Commissioner of Patents and Trademarks*